US006578825B1

(12) United States Patent
Brandt

(10) Patent No.: US 6,578,825 B1
(45) Date of Patent: Jun. 17, 2003

(54) WIRE ROPE EQUALIZER SYSTEM FOR HOIST MECHANISMS

(76) Inventor: Axel Brandt, 42724 Biland, Clinton Township, MI (US) 48038

( * ) Notice: Subject to any disclaimer, the term of this patent is extended or adjusted under 35 U.S.C. 154(b) by 0 days.

(21) Appl. No.: 09/911,917

(22) Filed: Jul. 24, 2001

Related U.S. Application Data

(60) Provisional application No. 60/220,281, filed on Jul. 24, 2000.

(51) Int. Cl.[7] ..... B66D 1/00

(52) U.S. Cl. ..... 254/392; 254/DIG. 14; 24/265 R

(58) Field of Search ..... 254/1, 264, DIG. 14, 254/392, 415, 399; 24/265 R

(56) References Cited

U.S. PATENT DOCUMENTS 3,648,979 A * 3/1972 Ratcliff ..... 254/264
3,656,210 A * 4/1972 Parker et al. ..... 24/265 R
4,717,189 A 1/1988 Gabriel ..... 294/82.32
5,954,210 A 9/1999 Kullmann et al. ..... 212/273

* cited by examiner

*Primary Examiner*—Kathy Matecki
*Assistant Examiner*—Sang Kim
(74) *Attorney, Agent, or Firm*—Rader, Fishman & Grauer, PLLC

(57) ABSTRACT

A wire rope equalizer system for a conventional double reeved hoist mechanism using wire rope is disclosed. The wire rope equalizer system includes a base member that is secured to the hoist mechanism for selective rotation and a pivoting lever that is pivotally connected to the base member. The pivoting member includes mounting extensions each having a mounting aperture therethrough that receives a ball shank that is secured to a distal end of the wire rope. Each mounting aperture has a grooved section that cooperates with the rounded end of the ball shank to permit rotational movement of the wire rope in a no load condition. Each mounting aperture further includes a conical section that flares outwardly in a lateral direction to permit selective lateral movement of the wire rope to counteract wire rope twist in a no load condition. An alternative embodiment for a single reeving hoist mechanism is also disclosed.

19 Claims, 5 Drawing Sheets

WIRE ROPE EQUALIZER SYSTEM FOR HOIST MECHANISMS

RELATED APPLICATIONS

This application claims the benefit of U.S. Provisional Application Serial No. 60/220,281 filed Jul. 24, 2000 entitled "WIRE ROPE EQUALIZER SYSTEM FOR HOIST MECHANISMS", hereby incorporated by reference in its entirety.

TECHNICAL FIELD

The invention is related to a wire rope holding device that permits relief from wire rope twist while maintaining rope design features under loading conditions.

BACKGROUND OF THE INVENTION

Wire rope is typically used for transporting and hoisting heavy pieces of machinery or the like. Because hoists utilizing wire rope are complex pieces of machinery, oftentimes containing hundreds of moving parts, proper application, maintenance and handling must be adhered to at all times in order to achieve maximum performance, safety, and service life.

One known condition that must be addressed in hoist mechanisms utilizing wire rope is called "wire rope twist". Wire rope twist is experienced when in loading conditions in combination with reverse bending induces torsion into the wire rope. However, reverse bending around rope drums and sheaves in the hoist mechanism cannot be avoided in hoist mechanisms. For example, referring to FIG. 1, in a standard double reeved design hoist, wire rope 10 is wound around a pulley 12 in a channel 14 formed therein to insure proper engagement with a wire rope sheave (not shown). To operate properly, the wire rope must have fixed end connections in order to maintain its strength under loading conditions. As a result, over time, wire rope twist will weaken the wire rope, thereby leading to a deterioration of operating conditions and safety.

To combat wire rope twist problems, known hoist designs require relief of wire rope twist both prior to installation and periodically during the service life of the wire rope to maintain integrity and to achieve the intended service life. To relieve wire rope twist, the wire rope must be removed from a supply drum or disconnected from the hoist and laid out on a clean surface. This method involves several disadvantages. First, removal of the wire rope results in operation downtime and increased expenses in removing and re-installing the wire rope. Further, when laying the wire rope out to provide the twist relief, great care must be made to insure that debris and dirt are not deposited on the wire rope, leading to degradation of the wire rope in the future. Finally, when the wire rope is re-attached, it must be properly lubricated to insure safe and reliable operation.

Accordingly, to alleviate the above-disadvantages, an improved hoist design that provides for a cost effective means to provide twist relief under a no load condition, but shill provided a fixed end connection under load condition is needed.

SUMMARY OF THE INVENTION

A wire rope equalizer system for a conventional hoist mechanism to provide wire rope twist relief is disclosed. In accordance with the invention, the equalizer system includes a base member and a pivoting lever connected thereto. The base member includes downwardly extending corresponding attachment arms that are spaced apart to form a channel therebetween. Extending through the attachment arms is a mounting aperture.

In accordance with one aspect of the invention, the pivoting member includes an upwardly extending attachment lip having a mounting hole therethrough. Attachment lip engages the channel formed by the corresponding attachment arms and the mounting hole aligns with the mounting apertures of the base member. A suitable fastener secures the pivoting lever to the base member such that the pivoting lever may selectively pivot to counteract uneven loads on the hoist mechanism.

In accordance with another aspect of the invention, pivoting lever 40 further includes corresponding mounting extensions positioned on either side of the attachment lip. Each mounting extension has a mounting aperture extending therethrough. Each mounting aperture has a grooved portion that generally corresponds in shape to the rounded end of a ball shank fitting that is secured to the distal end of the wire rope formed in then top surface of each mounting extension. A base of the grooved portion opens into a short throat portion. A bottom section of the throat section has outside edges that are slightly tapered outwardly. Opposite edges of the bottom section are substantially parallel to one another. Throat portion opens into a cone shaped portion that has outside edges that flare outwardly and open towards the bottom surface of the mounting extensions. Opposite edges of the cone shaped portion are substantially parallel to one another.

In operation, each distal end, with ball shank fitted secured thereto, is inserted into the mounting apertures of the pivoting lever with the rounded end of the ball shank engaged with the grooved section of the pivoting lever and the wire rope extending down through the cone shaped portion of the mounting apertures. The ball shank fittings cooperate with the grooved portion to permit selective rotation of the wire rope to counteract wire rope twist when in a no load condition. Further, the outwardly flaring outside edges of the cone shaped section, in cooperation with the generally parallel opposite edges, permit lateral, side-to-side movement to counteract wire rope twist. Moreover, the pivotal connection of the pivoting lever to the base member permits selective vertical movement of the wire ropes to compensate for unequal loading.

An alternative embodiment of the wire rope equalizer system for a single wire rope reeving hoist mechanism is also shown. In a single reeving system, a fixed portion of the hoist mechanism located above wire rope sheaves is provided with a mounting aperture that receives a socket with a distal end of the wire rope. The mounting aperture has a first diameter section that is sized to receive the socket that opens into an intermediate section that opens into a short conical section. The conical section has outside edges that flare outwardly toward the bottom surface of the fixed portion.

In accordance with one aspect of the invention, the socket has a grooved portion that is shaped to correspond to the rounded end of a ball shank fitting secured to the distal end of the wire rope. Grooved portion opens into a short throat portion that generally has a round shape. Throat portion terminates in a short cone shaped section that flares outwardly on all sides.

In operation, the socket is positioned within the first diameter section of the fixed portion of the hoist mechanism with the cone shaped section opening downwardly. The wire rope is threaded through the socket and the mounting aperture of the fixed portion with the ball shank fitting attached positioned in grooved portion of the socket for selective rotational movement. The ball shank fitting cooperates with the grooved portion of the socket and the downwardly opening conical section and cone shaped shaped section to permit movement of the wire rope in any lateral direction to counteract wire rope twist when the hoist mechanism is in a no load condition.

DETAILED DESCRIPTION OF THE PREFERRED EMBODIMENT

Figure 2:
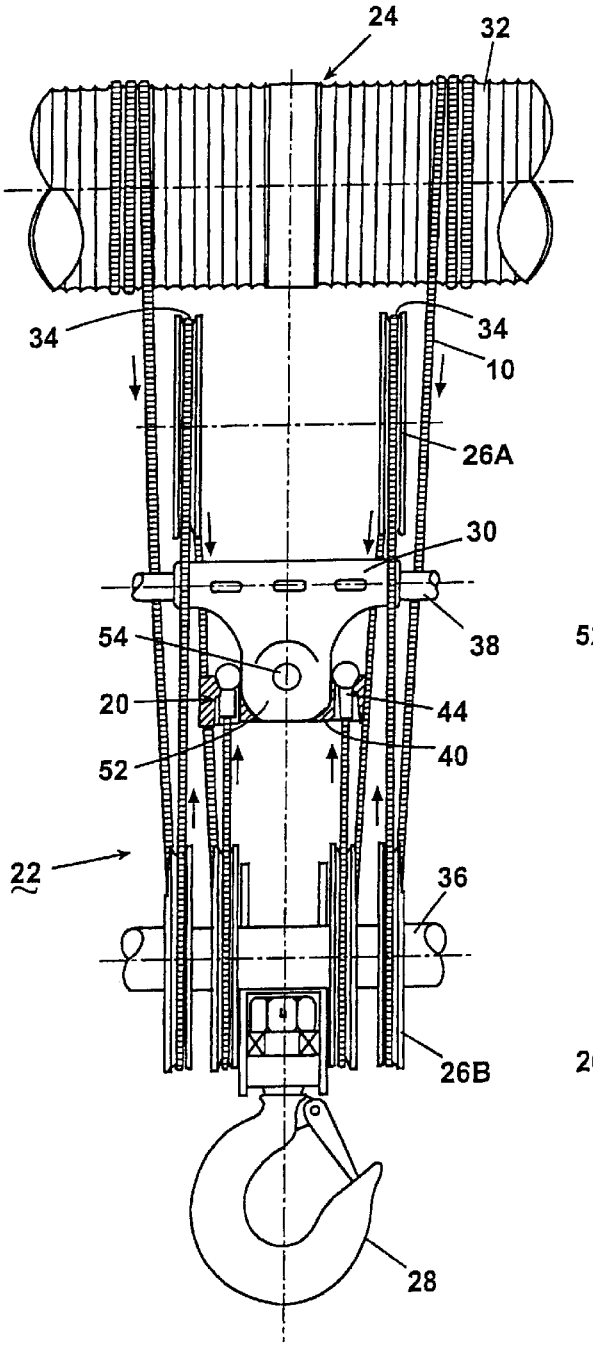
FIG. 2 is a frontal view of a double reeving hoist system having a wire rope equalizer system in accordance with the present invention.
Figure 3:
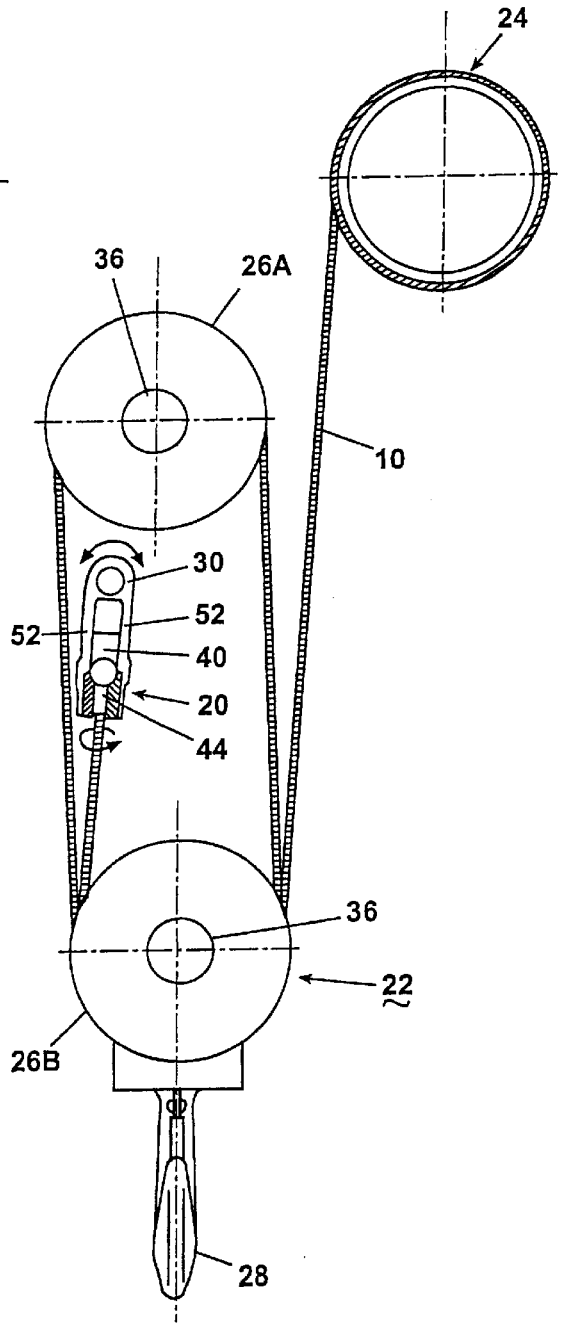
FIG. 3 is a side elevational view of the double reeving hoist system shown in FIG. 2.

Referring to FIGS. 2–3, a wire rope equalizer lever assembly 20 for a conventional double reeving hoist mechanism 22 is shown. Hoist mechanism 22 includes a wire rope drum 24 from which wire rope 10 is deployed and taken up in accordance with traditional hoisting mechanisms, a plurality of wire rope sheaves 26 that cooperate with drum 24 to raise and lower a hook 28, and a selectively pivoting base member 30 upon which wire rope equalizer lever assembly 20 is mounted on. Drum 24 has a plurality of grooves 32 having a diameter approximately equal to the diameter of wire rope 10 such that wire rope 10 fits snugly in grooves 32 as wire rope 10 is taken up onto drum 24, in a conventional manner. Similarly, sheaves 26 each have a groove 34 formed therein into which wire rope 10 is positioned. Sheaves 26 are mounted for rotational movement on shafts 36.

Figure 4:
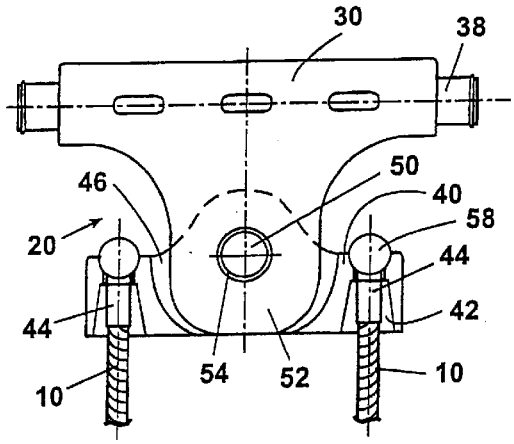
FIGS. 4–6 illustrate an enlarged views of the wire rope equalizer system of the present invention during various phases of operation.
Figure 5:
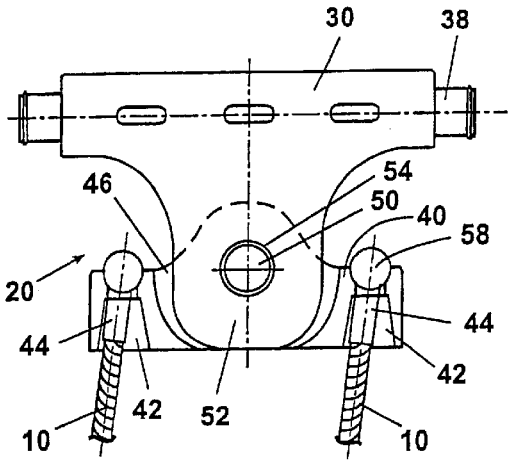
Figure 6:
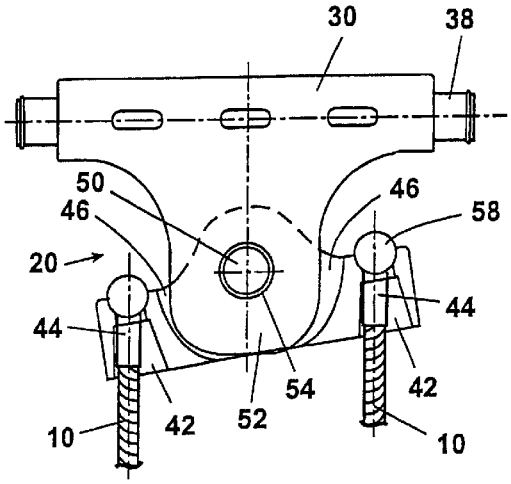

In accordance with the present invention, wire rope equalizer lever assembly 20 is mounted on pivoting base member 30. Base member 30 is mounted on a pivoting shaft 38 secured approximately equidistant between upper sheaves 26*a*. As best seen in FIGS. 4–6, wire rope equalizer lever assembly 20 includes a pivoting lever 40 having mounting apertures 42 for receiving ball shank fittings 44 secured to distal ends of wire rope 10.

Figure 7A:
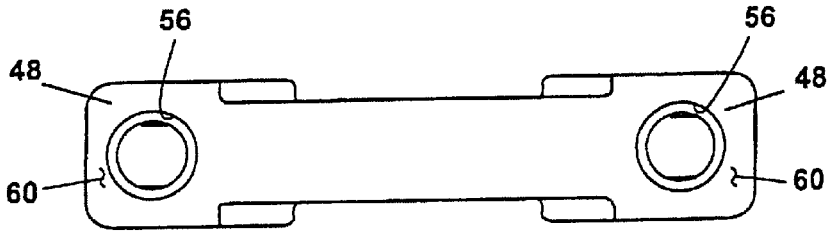
FIGS. 7*a*–7*c* illustrate the top, side, and bottom views, respectively, of a pivoting lever that is part of the wire rope equalizer system.
Figure 7B:
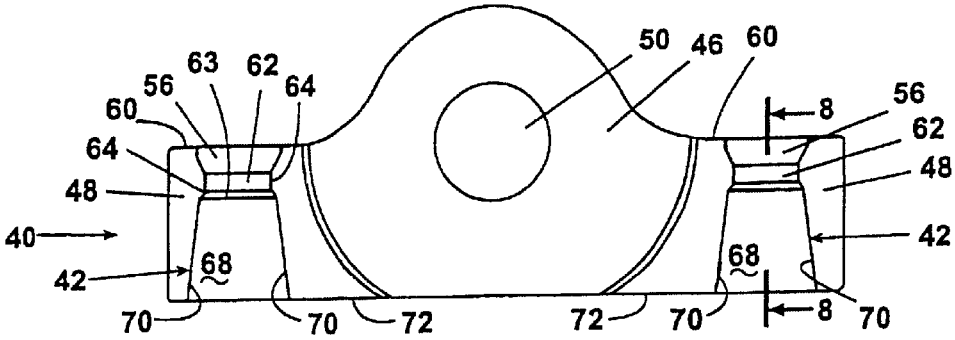
Figure 7C:
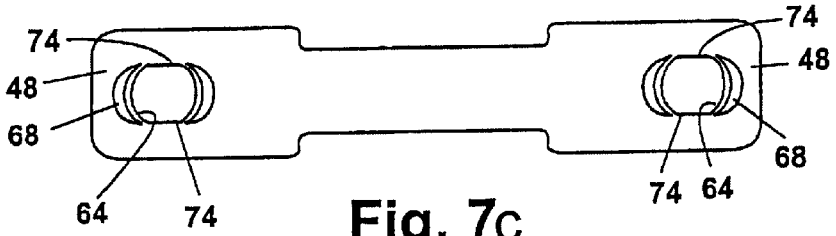

Referring to FIGS. 7*a*–*c*, pivoting lever 40 includes an upwardly extending attachment lip 46 positioned between corresponding mounting extensions 48 through which mounting apertures 42 are positioned. Attachment lip 46 has a mounting hole 50 therethrough. In accordance with one aspect of the invention, attachment lip 46 has a thickness that is slightly less than the thickness of mounting extensions 48.

Figure 8:
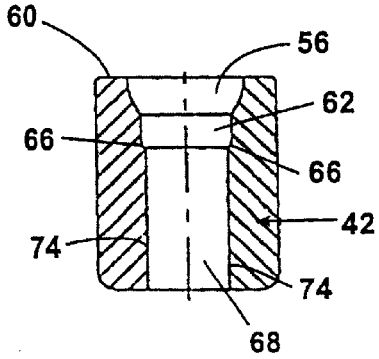
FIG. 8 is a partial cross-sectional view of the pivoting lever of FIG. 7.
Figure 9:
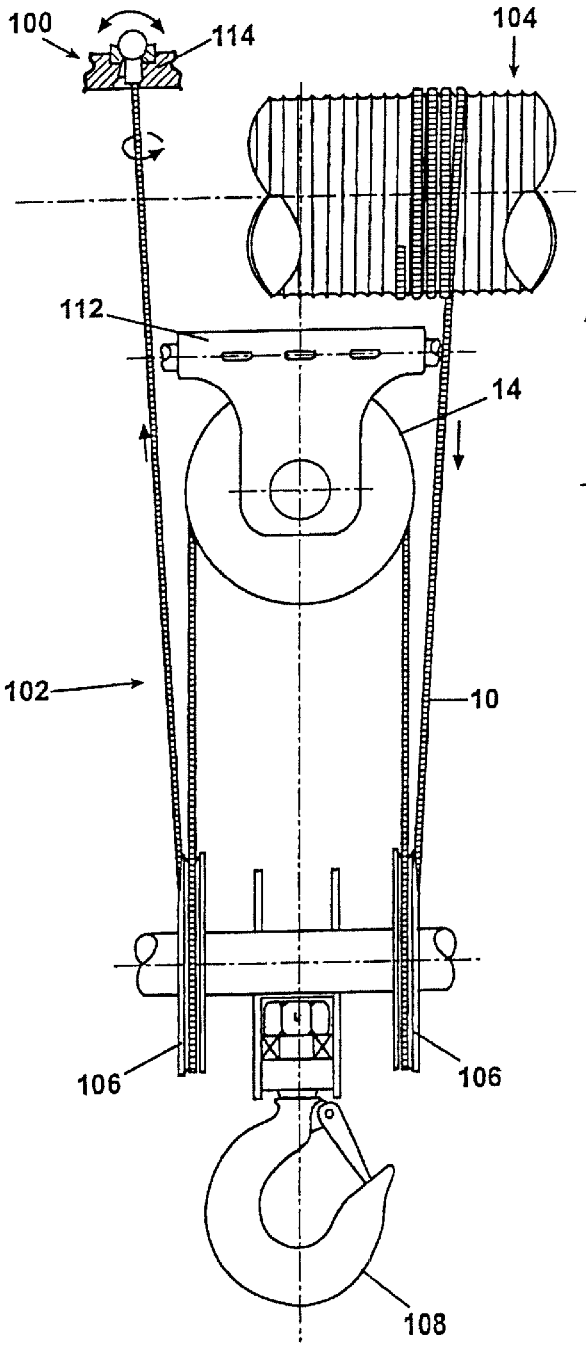
FIG. 9 is a frontal view of a single reeving hoist system having a wire rope equalizer system in accordance wit the present invention.
Figure 10:
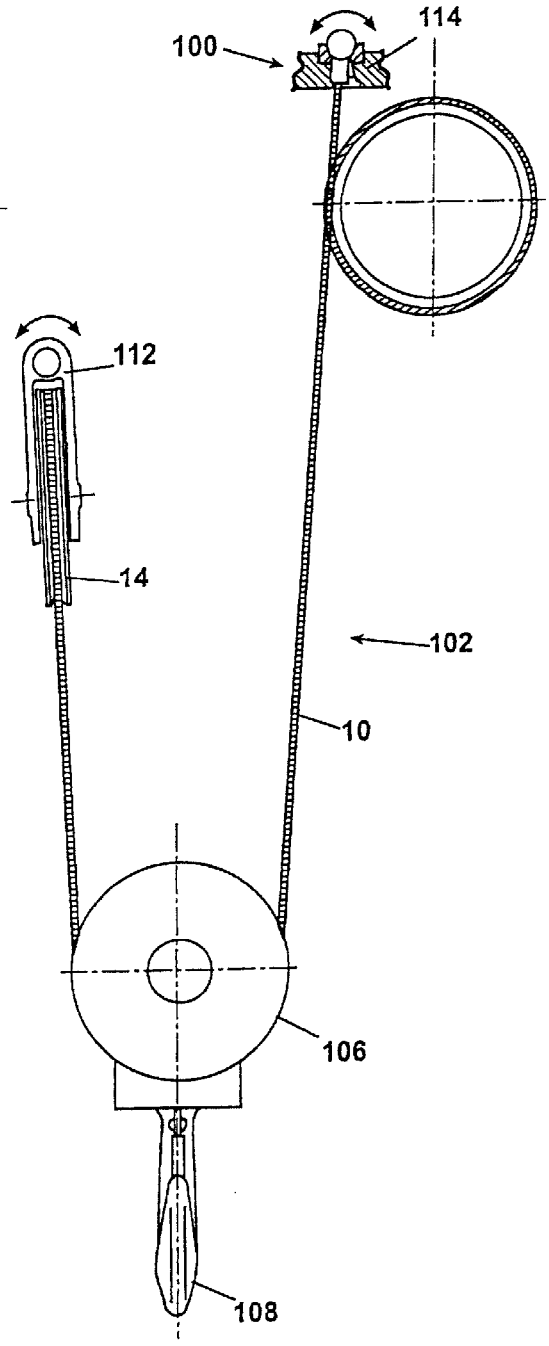
FIG. 10 is a side elevational view of the single reeving hoist system shown in FIG. 9.

Referring to FIGS. 7*a*–*c* and 8, in accordance with another aspect of the present invention, each mounting aperture 42 includes a grooved portion 56 having a predetermined shaped that corresponds to a rounded end 58 of a ball shank fitting 44 (as seen in FIGS. 4–6) formed in a top surface 60 of each mounting extension 48. A base of grooved portion 56 opens into a short throat portion 62. A bottom section 63 of throat portion 62 has outside edges 64 that are slightly tapered outwardly. Opposite edges 66 are substantially parallel to one another. Throat portion 62 opens into a cone shaped portion 68 that has outside edges 70 that flare outwardly towards a bottom portion 72 of each mounting extension 48. Opposite edges 74 are positioned parallel to one another and cooperate with outside edges 64 to form a parallel flat walls, as best seen in FIG. 8.

Referring to FIGS. 7 and 8, in accordance with another aspect of the present invention, each mounting aperture 42 includes a grooved portion 56 having a predetermined shaped that corresponds to a rounded end 58 of a ball shank fitting 44 (as seen in FIGS. 4–6) formed in a top surface 60 of each mounting extension 48. A base of grooved portion 56 opens into a short throat portion 62. A bottom section 63 of throat portion 62 has outside edges 64 that are slightly tapered outwardly. Opposite edges 66 are substantially parallel to one another. Throat portion 62 opens into a cone shaped portion 68 that has outside edges 70 that flare outwardly towards a bottom portion 72 of each mounting extension 48. Opposite edges 74 are positioned parallel to one another and cooperate with outside edges 64 to form a parallel flat walls, as best seen in FIG. 8.

In operation, each distal end of the doubled reeved wire rope 10 is inserted into mounting apertures 42 of pivoting lever 40. Ball shank fittings 44 (as best seen in FIGS. 4–7) are positioned on each distal end of wire rope with rounded end 58 engaging grooved portion 56 and wire rope extending downwardly through cone shaped portion 68. Thus, wire rope 10 is permitted to hand freely through cone shaped portion 68. As illustrated in FIGS. 4–6, ball shank fittings 44 cooperate with grooved portion 56 to permit selective rotation of wire rope t counteract wire rope twist when in a no load condition. Further, in accordance with another aspect of the invention, outwardly flaring outside edges 70 permit side-to-side movement to counteract wire rope twist in a no load condition, as seen in FIGS. 5 and 6. Finally, the pivotal connection of pivoting lever 40 and base member permit up and down movement of wire ropes 10 to compensate for unequal loading, as seen in FIG. 6. In sum, wire rope equalizer system 10 permits selective movement of wire rope 10 in a no load connection to alleviate ire rope twist without requiring complete removal of wire rope 10 from hoist mechanism 22, but also provides a fixed connection in a load condition.

Figure 1:
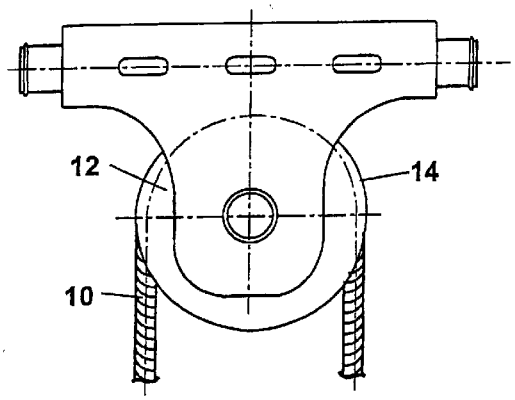
Fig. 1 (PRIOR ART)
FIG. 1 is shows a frontal view of a prior art pivot lever having pulley for guiding a wire rope in a double reeving hoist system.

Referring to FIGS. 9–13*a*–*c*, an alternative wire rope equalizer system 100 for a single reeved hoist mechanism 102 is illustrated. Single reeved hoist mechanism 102 includes a wire rope drum 104 from which wire rope 10 is deployed and taken up in accordance with traditional hoisting mechanisms, a pair of lower wire rope sheaves 106 that cooperate with drum 102 to raise and lower a hook 108, a conventional upper wire rope sheave 14, such as that shown in FIG. 1, operatively connected to a base member 112 and wire rope equalizer system 100. Base member 112 corresponds generally to base member 30.

Figure 11:
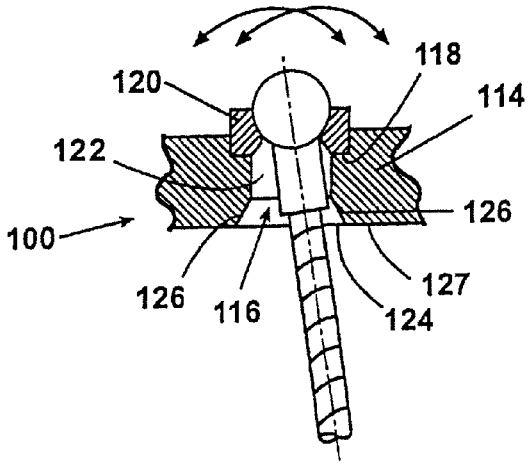
FIG. 11 is an enlarged view of the single wire rope equalizer system of the present invention.
Figure 13A:
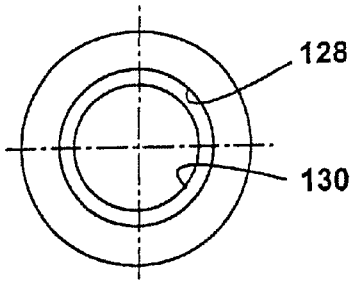
FIG. 13*a* illustrates the top view of a socket shown in FIGS. 11 and 12.
Figure 13B:
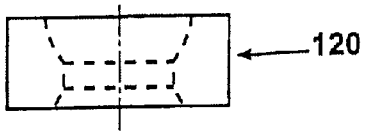
FIG. 13*b* illustrates the elevational view of the socket.
Figure 13C:
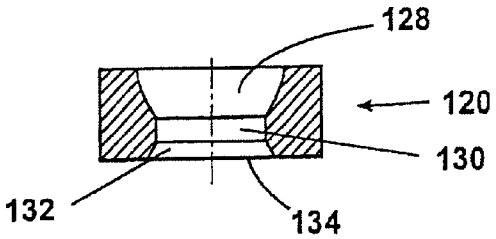
FIG. 13*c* illustrates the cross-sectional view of the socket.
Figure 12:
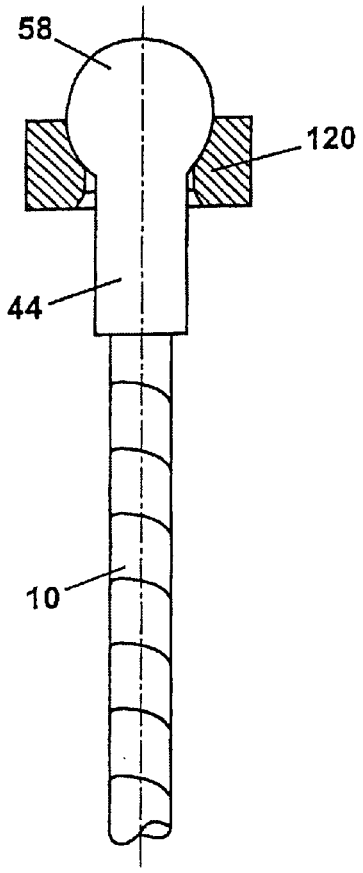
FIG. 12 is an enlarged view of a ball shank and end fitting of the single reeving wire rope equalizer system.

In operation, socket 120 is positioned within first diameter section 118 with cone shaped section 132 opening downwardly. As can be seen in FIG. 11, the bottom 134 of cone shaped section 132 has a diameter that substantially corresponds to the diameter of intermediate section 122. Next, wire rope 10 is inserted through socket 120 and mounting aperture 116. A distal end of wire rope 10 is secured to ball shank fitting 44 and ball shank fitting 44 is positioned in grooved portion 128.

In accordance with the present invention, ball shank fitting 44 of wire rope equalizer system 100 operates to permit rotational movement of the distal end of wire rope 10 to counteract wire rope twist in a no load condition and without incurring manufacturing downtime. Similarly, outside edges 126 of conical section 124 permits lateral motion in response to loading requirements of the hoist mechanism.

While system 100 is shown in connection with a single reeved system, it is understood that an additional fixed portion 114 with socket 120 could be provided and properly positioned to allow for a doubled reeved wire rope hoist.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A wire rope equalizer system for a conventional hoist mechanism, comprising:

a base member mounted on the hoist mechanism for selective pivotal movement, said base member having at least one attachment arm;

a lever member having at least one attachment lip that cooperate with said attachment arm to pivotally connect said lever member with said base member;

wherein said lever member further includes mounting extensions positioned on opposite sides of said attachment lip, said mounting extensions having mounting apertures formed therethrough, said mounting apertures adapted to received distal ends of a wire rope such that said wire rope is free to rotate to counteract wire rope twist in a no load condition.

2. The wire rope equalizer system of claim 1, wherein each of said apertures includes a grooved sectioned, a throat section and a downwardly opening conical section.

3. The wire rope equalizer system of claim 2, wherein said grooved section is formed in a top surface of said mounting extension and opens into said throat section.

4. The wire rope equalizer system of claim 3, wherein said distal ends of the wire rope are each secured to a ball shank fitting.

5. The wire rope equalizer system of claim 4, wherein said grooved section shaped so as to receive said ball shank fitting for selective rotational movement.

6. The wire rope equalizer system of claim 2, wherein said throat section is slightly tapered outwardly in a downward direction towards said conical section.

7. The wire rope equalizer system of claim 6, wherein outside edges of said throat section are slightly tapered outwardly towards said conical section and where opposite edges of said throat section are substantially parallel.

8. The wire rope equalizer system of claim 2, wherein said conical section is angled outwardly in a downward direction through a bottom surface of said mounting extension.

9. The wire rope equalizer system of claim 8, wherein outside edges of said conical section are angled outwardly in a downward direction, and where opposite edges of said conical section are substantially parallel.

10. The wire rope equalizer system of claim 1, wherein said attachment lip extends upwardly between said mounting extensions and includes a mounting hole therethrough.

11. The wire rope equalizer system of claim 10, wherein said attachment lip has a thickness that is slightly less than the thickness of said mounting extension.

12. The wire rope equalizer system of claim 10, wherein said base member includes a pair of downwardly extending attachment arms spaced apart from one another to form a channel therebetween, said attachment arms having a mounting apertures therethrough that corresponds in size and shape to said mounting hole of said attachment lip, wherein said attachment lip engages said channel and said mounting hole aligns with said mounting apertures of said attachment arms and a fastener secures said pivot lever to said base member such that said pivot lever is selectively pivotal in response to uneven loading.

13. A wire rope equalizer system for a hoist mechanism, comprising:

a base member mounted on the hoist mechanism for selective pivotal movement, said base member having a pair of downwardly extending attachment arms, each having a mounting aperture formed therethrough, said attachment arms spaced from one another and cooperating for form a channel therebetween;

a lever member having an upwardly extending attachment lip with a mounting hole therethrough, said attachment lip engaging said channel and said mounting hole aligning with said mounting apertures of said attachment arms and receiving a fastener to pivotally connect said lever member with said base member;

wherein said lever member further includes mounting extensions positioned on opposite sides of said attachment lip, said mounting extensions having mounting apertures formed therethrough, each of said mounting apertures having a grooved portion formed in a top surface of said mounting extensions and adapted to received a ball shank secured to a distal end of a wire rope, said grooved portion opening into a throat section, and said throat section opening into an outwardly extending conical section that opens in through a bottom surface of said mounting extension such that said wire rope is free to rotate and move in a lateral direction to counteract wire rope twist in a no load condition.

14. The wire rope equalizer system of claim 13, wherein said conical section has outside edges that are tapered outwardly toward said bottom surface and opposite edges that are substantially parallel to selectively permit the wire rope to move in a lateral direction to counteract wire rope twist.

15. A wire rope equalizer system for a hoist mechanism, comprising:

a fixed portion of the hoist mechanism that is secured to said hoist mechanism, said fixed portion having a mounting aperture therethrough;

wherein said mounting aperture has a downwardly opening conical section;

a socket that is at least partially received in a portion of said mounting aperture, said socket including a grooved section, a throat portion and a downwardly opening cone shaped section;

said socket receiving a distal end of a wire rope;

wherein said wire rope is free to rotate and to move in a lateral direction to counteract wire rope twist in a no load condition.

16. The wire rope equalizer system of claim 15, wherein said distal end of said wire rope has a ball shank fitting secured thereto, said ball shank fitting engaging said grooved section of said socket such that said wire is permitted to selectively rotate to counteract wire rope twist.

17. The wire rope equalizer system of claim 15, wherein said mounting aperture includes a first diameter section, an intermediate portion and a downwardly opening conical section.

18. The wire rope equalizer system of claim 17, wherein said socket is partially received in said first diameter section such that said cone shaped section opens into said intermediate portion.

19. The wire rope equalizer system of claim 18, wherein outside edges of said conical section taper outwardly towards said bottom surface of said fixed portion and opposite edges of said conical section are substantially parallel, such that said wire rope is permitted selective lateral movement to counteract wire rope twist.

* * * * *